US007222849B2

(12) United States Patent
Ono

(10) Patent No.: US 7,222,849 B2
(45) Date of Patent: May 29, 2007

(54) FEEDING METHOD AND APPARATUS FOR SHEET-SHAPED RECORDING MATERIAL

(75) Inventor: Takehisa Ono, Kanagawa (JP)

(73) Assignee: Fujifilm Corporation, Kanagawa (JP)

( * ) Notice: Subject to any disclaimer, the term of this patent is extended or adjusted under 35 U.S.C. 154(b) by 272 days.

(21) Appl. No.: 10/940,726

(22) Filed: Sep. 15, 2004

(65) Prior Publication Data

US 2005/0067775 A1 Mar. 31, 2005

(30) Foreign Application Priority Data

Sep. 16, 2003 (JP) ..... 2003-323066

(51) Int. Cl.
*B65H 29/20* (2006.01)

(52) U.S. Cl. ..... 271/272; 271/265.02

(58) Field of Classification Search ..... 271/272–274, 271/258.01, 259, 265.01, 265.02; 226/181–187
See application file for complete search history.

(56) References Cited

U.S. PATENT DOCUMENTS 6,505,833 B2 * 1/2003 Kato et al. ..... 271/272
7,036,923 B2 * 5/2006 Takagi et al. ..... 347/104

FOREIGN PATENT DOCUMENTS

JP 2001-033883 A 2/2001
JP 2002-003002 A 1/2002

* cited by examiner

*Primary Examiner*—Patrick Mackey
*Assistant Examiner*—Jeremy R Severson
(74) *Attorney, Agent, or Firm*—Birch, Stewart, Kolasch & Birch, LLP

(57) ABSTRACT

Feeding roller pairs are respectively constituted of a capstan roller and a nip roller. The nip roller is movable between a nip position and a release position. When movement timing of the nip rollers overlap, a pulse motor for moving the nip rollers is successively driven. For example, a drive-pulse speed for the pulse motor is detected at the moment that the downstream nip roller is moved to the nip position (at the moment that a predetermined time has passed after detecting a recording-paper sheet with a position sensor). And then, the drive-pulse speed is changed in accordance with the detected drive-pulse speed to drive the pulse motor at a prescribed speed.

17 Claims, 12 Drawing Sheets

FEEDING METHOD AND APPARATUS FOR SHEET-SHAPED RECORDING MATERIAL

This Nonprovisional application claims priority under 35 U.S.C. § 119(a) on patent application No(s). 2003-323066 filed in Japan on Sep. 16, 2003, the entire contents of which are hereby incorporated by reference.

BACKGROUND OF THE INVENTION

1. Field of the Invention

The present invention relates to a method and an apparatus for feeding a sheet-shaped recording material, and in particular relates to operation control of roller pairs for nipping and feeding the recording material.

2. Description of the Related Art

A photo printer for recording an image on a sheet-shaped photosensitive material is widely known. In this kind of the photo printer, recording light is applied in a scanning direction while the photosensitive material is fed in a sub-scanning direction perpendicular to the scanning direction. The photo printer includes a plurality of feeding roller pairs comprising a capstan roller and a nip roller. The recording material is nipped and fed by the feeding roller pair.

In order to prevent density unevenness of a recording image to be caused by fluctuation of a feeding speed, it is necessary to accurately feed the photosensitive material at the time of image recording. In view of this, Japanese Patent Laid-Open Publication No. 2001-33883 teaches nip rollers respectively disposed at an upstream side and a downstream side of a record head for irradiating the recording light. The nip roller is movable between a nip position where the photosensitive material is nipped, and a release position where the nip is released. The respective nip rollers start to move when an anterior end or a posterior end of the photosensitive material has reached a predetermined position. In virtue of this, nipping and releasing the photosensitive material are performed at prescribed timing even if a length and a feeding speed of the photosensitive material are different. Thus, quality of the recording image may be kept in a good condition.

Meanwhile, Japanese Patent Laid-Open Publication No. 2002-3002 teaches nip rollers of an upstream side and a down stream side, which are moved by a single pulse motor. A movement speed of the nip roller is changed in accordance with a length of the photosensitive material. By doing so, shock to be caused to the photosensitive material is reduced when a feeding roller pair performs nipping and releasing.

In order to improve processing ability of the photo printer, it is preferable to increase the feeding speed of the photosensitive material. In addition, it is preferable to reduce an interval between the photosensitive materials successively fed. In this case, there is a possibility that drive timing of the respective nip rollers overlap. That is, timing for moving the upstream nip roller to the release position occurs while the downstream nip roller moves toward the nip position.

The drive timing of the nip rollers are usually designed so as not to overlap with each other. In case the drive timing of the nip rollers overlap, it is necessary to temporarily stop feeding the photosensitive material, since an operation is judged as being abnormal. Alternatively, it is necessary to stop the operation itself of the photo printer. In this case, the feeding speed changes while the image is recorded. Thus, the density unevenness is most likely to be caused. Further, there arises a problem in that the processing ability of the photo printer remarkably deteriorates, since feeding the photosensitive material is stopped.

SUMMARY OF THE INVENTION

In view of the foregoing, it is a primary object of the present invention to provide a feeding method and a feeding apparatus in which a recording material is stably fed without lowering a feeding speed even if drive timing of feeding roller pairs overlap.

In order to achieve the above and other objects, the feeding method according to the present invention comprises the steps of performing a movement operation of one of movable rollers, judging whether or not interrupt timing for moving the other movable roller occurs during the movement operation of the one of the movable rollers, and prioritizing a movement operation of the other movable roller when the interrupt timing has occurred. The movable rollers are an upstream movable roller and a downstream movable roller respectively constituting an upstream roller pair and a downstream roller pair, which are disposed at an upstream side and a downstream side of a recording position in a feeding direction of a sheet-shaped recording material. Each of the movable rollers is movable between a nip position for nipping and feeding the recording material, and a release position for releasing the nip of the recording material.

In a preferred embodiment, the movable rollers are moved by a single pulse motor. When the interrupt timing occurs during the movement operation of the one of the movable rollers, drive pulses, whose speed is determined based on the other movable roller, are supplied to the pulse motor. It is preferable that a number of the drive pulses to be successively supplied to the pulse motor is a total of drive-pulse numbers required for moving the one of the movable rollers and the other movable roller.

As to a movement speed of the downstream movable roller, it is preferable that the movement speed toward the nip position is slower than that toward the release position. In the meantime, as to a movement speed of the upstream movable roller, it is preferable that the movement speed toward the release position is slower than that toward the nip position. Further, it is preferable that an occurrence number of the interrupt timing is counted.

In the feeding apparatus according to the present invention, an upstream roller pair and a downstream roller pair are disposed at an upstream side and a downstream side of a recording position in a feeding direction of a sheet-shaped recording material. An upstream movable roller and a downstream movable roller constituting the upstream roller pair and the downstream roller pair are respectively movable between a nip position for nipping and feeding the recording material, and a release position for releasing the nip of the recording material. The feeding apparatus comprises a first moving mechanism, a second moving mechanism and a movement controller. The first moving mechanism moves one of the movable rollers. The second moving mechanism moves the other movable roller. The movement controller controls the first and second moving mechanisms in accordance with a position of the recording material. The controller judges whether or not interrupt timing for moving the other movable roller occurs during the movement operation of the one of the movable rollers. When the interrupt timing has occurred, the controller prioritizes the movement operation of the other movable roller.

According to the present invention, when the interrupt timing occurs during the movement operation of the one of the movable rollers, the movement operation of the other movable roller is prioritized. Thus, it is possible to make the feeding operation stable. Further, the drive pulse, whose speed is determined based on the movement operation of the other movable roller, is supplied to the pulse motor. Thus, a delay of timing for nipping/releasing the recording material is kept to the minimum.

The number of the drive pulses to be successively supplied to the pulse motor is a total of drive-pulse numbers required for moving the movable rollers. Thus, a stop position of the movable roller may be surely controlled even if the movement timing of the movable rollers overlap.

The movement speed of the downstream movable roller toward the nip position is slower than that thereof toward the release position, and the movement speed of the upstream movable roller toward the release position is slower than that thereof toward the nip position. Thus, it is possible to reduce a shock of the recording material to be caused in association with the nipping/releasing operation. Further, the occurrence number of the interrupt timing is counted. Thus, it is possible to specify a place where the movement timing of the movable rollers are likely to overlap.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
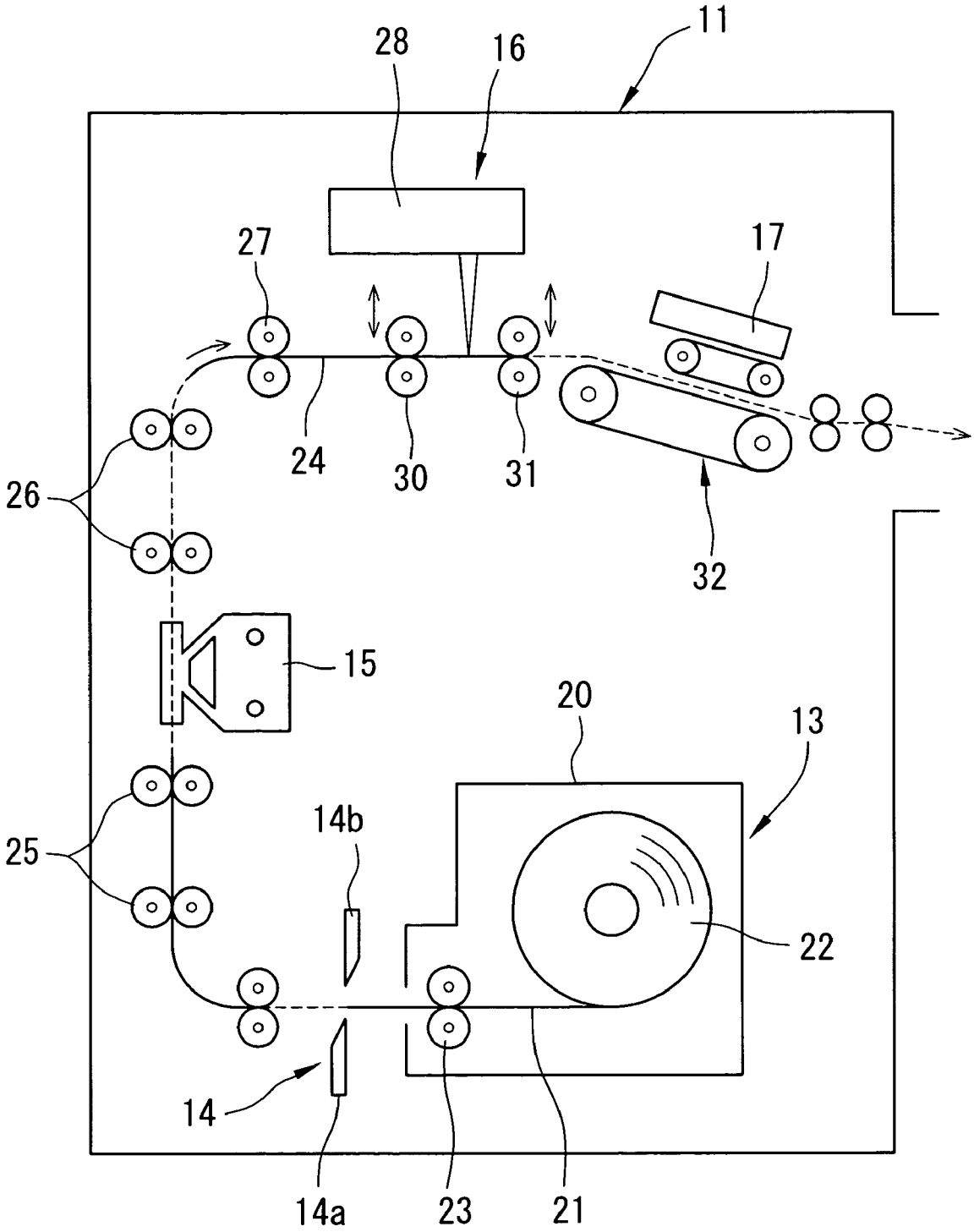
FIG. 1 is an explanatory illustration schematically showing a structure of a printer.

An embodiment of the present invention is described below, referring to the drawings. FIG. 1 schematically shows a printer 11 of a photo printer. The printer 11 includes a paper-roll chamber 13, a cutter 14, a back-printing unit 15, an image recorder 16 and a sorter 17.

A magazine 20 disposed in the paper-roll chamber 13 contains a recording-paper roll 22 formed by rolling a sheet-shaped photosensitive recording paper 21, which is used as a recording material. The recording paper 21 is formed such that a surface of at least an emulsion coating side (image recording side) of a substrate is covered with a composition, in which white pigment is mixed and dispersed in a resin including polyester or the like. The substrate is made of a base paper and so forth. Meanwhile, a paper-feed roller pair 23 is disposed near a paper mouth of the magazine 20. When the paper-feed roller pair 23 is rotated by a drive motor, which is not shown, the recording paper 21 is drawn out of the recording-paper roll 22 and is advanced toward the cutter 14.

The cutter 14 is constituted of a fixed blade 14*a* and a movable blade 14*b*, which are disposed across a passage of the recording paper 21. When an anterior end of the recording paper 21 is advanced from the cutter 14 by a predetermined length, a cutter driving mechanism not shown is actuated to move the movable blade 14*b* toward the fixed blade 14*a*. Thereupon, the recording paper 21 is cut to produce a recording-paper sheet 24 having the predetermined length. The recording-paper sheet 24 is transported toward the back-printing unit 15 by advancing roller pairs 25 and along a guide rail, which is not shown. In the back-printing unit 15, necessary information including film ID, a frame number and so forth is printed on a rear surface (opposite surface to an emulsion layer) of the recording-paper sheet 24.

The recording-paper sheet 24 for which back printing has been performed is transported to the image recorder 16 by advancing roller pairs 26 and 27. The image recorder 16 is constituted of an exposure device 28 for radiating recording light toward the recording-paper sheet 24, and a feeding mechanism for moving the recording-paper sheet 24 in the image recorder 16. The feeding mechanism comprises a first feeding roller pair 30 for feeding the recording-paper sheet 24 to an exposure position, and a second feeding roller pair 31 for feeding the exposed sheet 24 to a belt conveyor 32.

The exposure device 28 comprises a well-known laser printer and an image memory for storing image data read by a film scanner, which is not shown. Alternatively, the image memory stores image data outputted from a recording medium of a memory card or the like, which is not shown. The laser printer irradiates the recording-paper sheet 24 with a laser, whose intensity is modulated on the basis of the image data stored in the image memory, to perform exposure recording of an image. The exposed sheet 24 is advanced to the belt conveyor 32. The recording-paper sheets 24 are sorted into plural rows by the sorter 17 while transported by the belt conveyor 32. And then, the recording-paper sheet 24 is advanced to a processing unit (not shown) wherein various processes of coloring, fixing and washing are performed. After these processes, a drying process is performed in the processing unit. Ultimately, the recording-paper sheet is discharged to the outside of the printer as a photo print.

Figure 2:
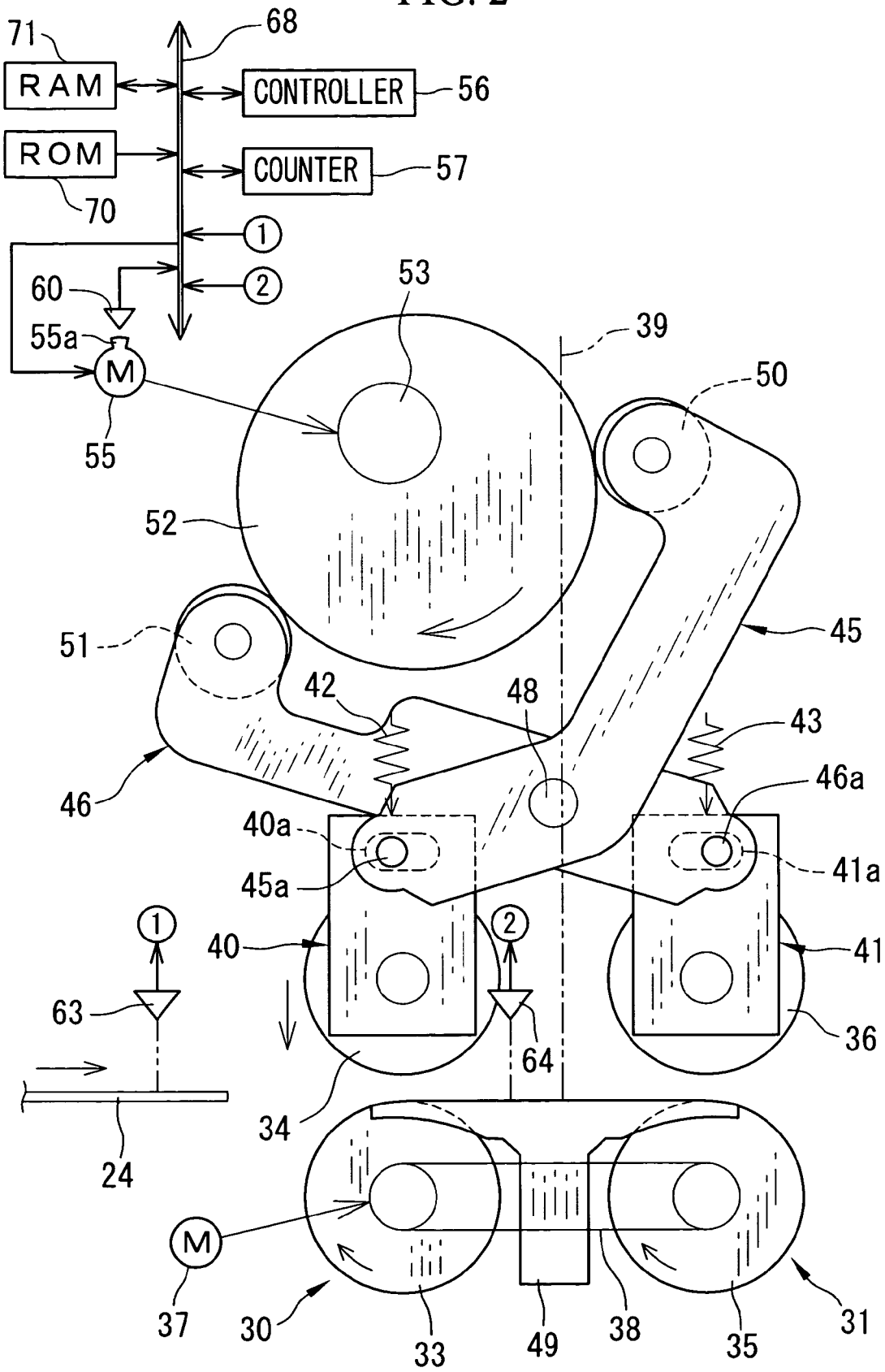
FIG. 2 is a plan view schematically showing a structure of a feeding mechanism, wherein nip rollers of an upstream side and a downstream side are kept in a release position.

FIG. 2 schematically shows the feeding mechanism of the image recorder 16. The first feeding roller pair 30 is constituted of a capstan roller 33 and a nip roller 34 being as a driven roller, which are disposed so as to nip an upper side of a guide member 49. Similarly, the second feeding roller pair 31 is constituted of a capstan roller 35 and a nip roller 36 being as a driven roller, which are disposed so as to nip the upper side of the guide member 49. The capstan roller 33 of the first feeding roller pair 30 is connected to a motor 37 via a gear train, which is not shown. As to the motor 37, is used a pulse motor having one hundred rotor teeth and five phases, for example. Drive pulses are supplied to the motor 37 so as to always rotate it at uniform velocity. Incidentally, an inelastic steal belt 38 is laid between the capstan rollers 33 and 35, which are rotated at the uniform velocity by the sole motor 37.

Upon activating the motor 37 to rotate the capstan rollers 33 and 35, the recording-paper sheet 24 nipped by the nip rollers 34 and 36 is transported at a constant speed in a direction shown by an arrow (in a sub-scanning direction). When the recording-paper sheet 24 passes the exposure position 39, the exposure device 28 applies the laser beam in a scanning direction (in a perpendicular direction relative to the drawing), which intersects with the sub-scanning direction at right angles, to perform the exposure one line by one line. Incidentally, the advancing roller pair 27 (see FIG. 1) comprises a one-way clutch. A conveyance speed of the sheet 24 conveyed by the roller pair 27 is determined so as to be smaller than a feed speed of the sheet 24 fed by the first feeding roller pair 30. Consequently, the advancing roller pair 27 becomes free at the moment that the recording-paper sheet is nipped and fed by the first feeding roller pair 30. Thus, it is possible to hold down speed fluctuation to be caused by movement transition of the recording-paper sheet 24.

The nip rollers 34 and 36 are rotatably supported by brackets 40 and 41 respectively disposed at both sides thereof in the scanning direction. The brackets 40 and 41 are guided by guide plates, which are not shown, so as to be vertically movable. The brackets 40 and 41 are urged toward the capstan rollers 33 and 35 with compression springs 42 and 43 by which the nip rollers 34 and 36 are pressed against the capstan rollers 33 and 35 to nip the recording-paper sheet 24.

Elongate holes 40*a* and 41*a* formed in the brackets 40 and 41 respectively engage with guide pins 45*a* and 46*a* formed at ends of drive levers 45 and 46. The drive levers 45 and 46 are rotatably attached to each other by an attachment shaft 48 so as to intersect. Cam followers 50 and 51 attached to the other ends of the drive levers 45 and 46 abut on a peripheral surface of an eccentric cam 52. Upon rotating the eccentric cam 52, the other ends of the drive levers 45 and 46 are pushed so that the drive levers 45 and 46 are rotated around the attachment shaft 48. Owing to this, the nip rollers 34 and 36 are vertically moved between the nip position for nipping the recording-paper sheet 24, and the release position for releasing the nip of the recording-paper sheet 24.

A rotary shaft 53 of the eccentric cam 52 is connected to a pulse motor 55 via a gear train, which is not shown. The pulse motor 55 is connected to a controller 56 and is activated by receiving drive pulses from the controller 56. When the pulse motor 55 is driven to rotate an output shaft thereof, the eccentric cam 52 is rotated around the rotary shaft 53 in a clockwise direction. The output shaft of the pulse motor 55 is rotated by a predetermined angle per one drive pulse. Thus, by counting a number of the drive pulses with a counter 57, it is possible to detect a rotational position of the eccentric cam 52, namely movement positions of the nip rollers 34 and 36. Meanwhile, a reference-position sensor 60 is disposed near the pulse motor 55. The reference-position sensor 60 comprises alight emitting portion and a light receiving portion to detect a passage of a projection 55*a* formed on the output shaft of the pulse motor 55.

First and second position sensors 63 and 64 for detecting the passage of the recording-paper sheet 24 are respectively disposed at the upstream sides of the nip rollers 34 and 36. Each of the first and second position sensors 63 and 64 is constituted of a light emitting portion and a light receiving portion. The light emitting portion radiates the light downward in the drawing, and the light receiving portion detects the reflected light. When intensity of the reflected light has changed, it is detected that the anterior end or the posterior end of the recording-paper sheet 24 has passed.

When the recording-paper sheet 24 is not fed, the eccentric cam 52 is stopped at a position where the reference-position sensor 60 detects the projection 55*a*. At this time, the eccentric cam 52 depresses the other ends of the drive levers 45 and 46 so as to keep each of the nip rollers 34 and 36 in the releasing position. Thus, the nip rollers 34 and 36 are prevented, at the time of nonuse, from being pressed against the capstan rollers 33, 35 and from being deformed.

Figure 3:
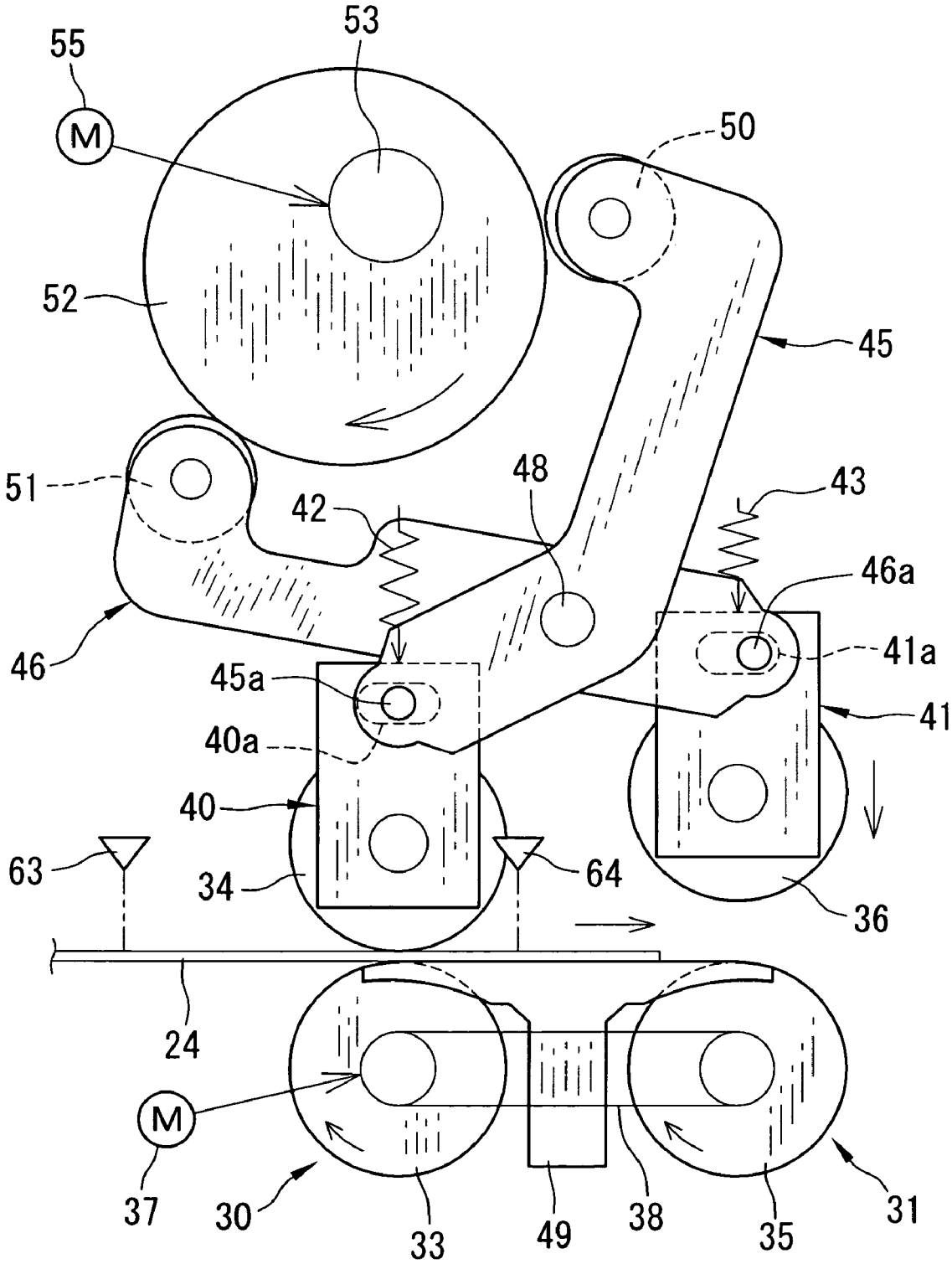
FIG. 3 is a plan view schematically showing the structure of the feeding mechanism, wherein the upstream nip roller is kept in a nip position and the downstream nip roller is kept in the release position.

When the recording-paper sheet 24 is transported and the anterior end thereof is detected by the first position sensor 63, the controller 56 supplies the drive pulse to the pulse motor 55 to rotate the eccentric cam 52 from the position shown in FIG. 2 to the position shown in FIG. 3. By rotating the eccentric cam 52, the drive lever 45 is rotated in a counterclockwise direction. The nip roller 34 of the upstream side is gradually moved downward and is stopped at the nip position shown in FIG. 3.

Figure 4:
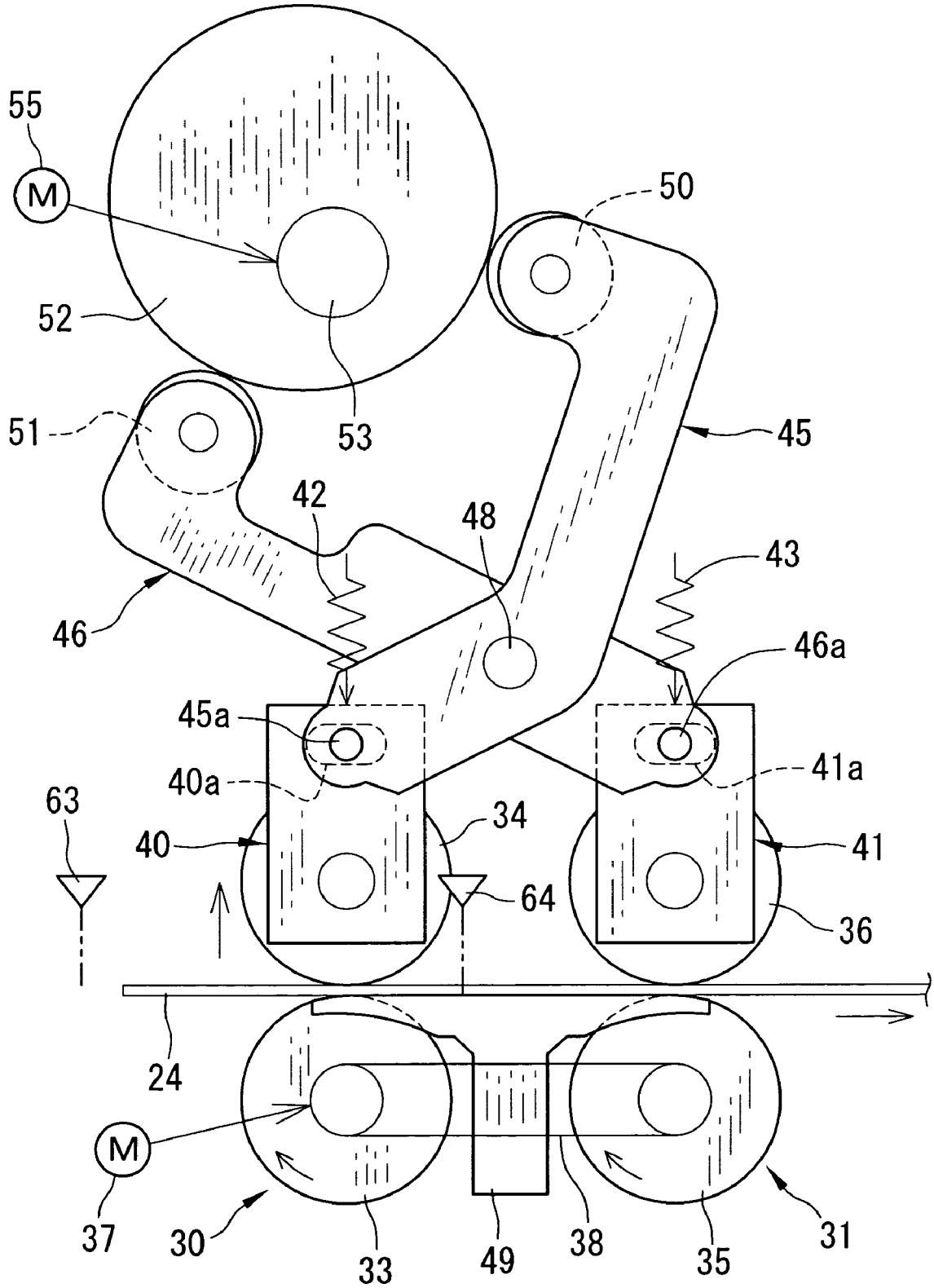
FIG. 4 is a plan view schematically showing the structure of the feeding mechanism, wherein both of the nip rollers are kept in the nip position.

The recording-paper sheet 24 is nipped and fed by the first feeding roller pair 30 and the anterior end thereof passes the second position sensor 64. Then, the eccentric cam 52 is rotated in the clockwise direction from the position shown in FIG. 3 to the position shown in FIG. 4 to merely rotate the drive lever 46. Only the nip roller 36 of the downstream side is gradually moved toward the nip position in the state that the nip roller 34 of the upstream side is kept in the nip position. After the anterior end of the recording-paper sheet 24 has passed the second feeding roller pair 31, the nip roller 36 reaches the nip position shown in FIG. 4. Thus, it is possible to eliminate a shock when the recording-paper sheet 24 enters the second feeding roller pair 31.

Figure 5:
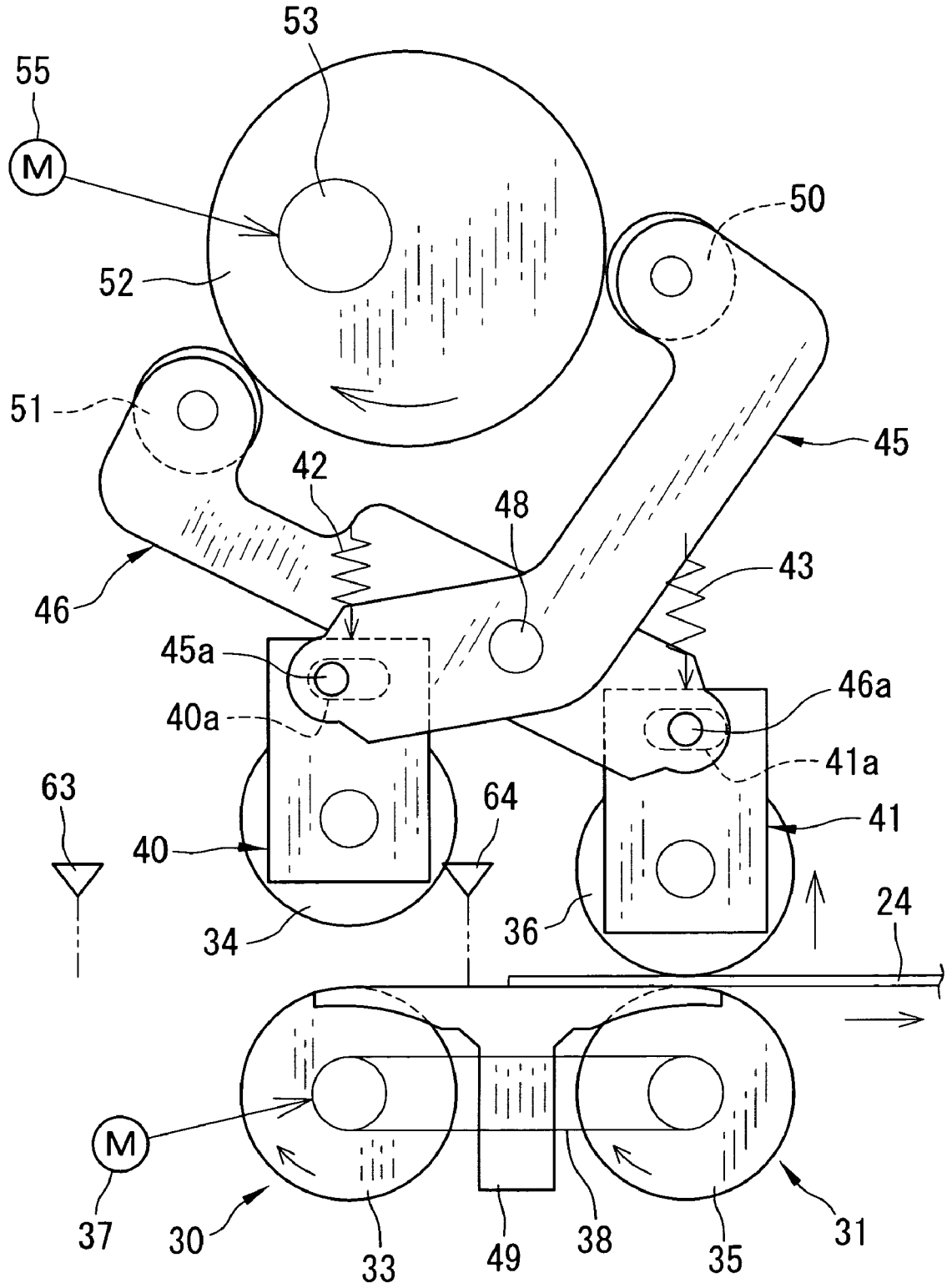
FIG. 5 is a plan view schematically showing the structure of the feeding mechanism, wherein the upstream nip roller is kept in the release position and the downstream nip roller is kept in the nip position.

The recording-paper sheet 24 is nipped by the first and second roller pairs 30 and 31. In this state, the recording-paper sheet 24 is fed at a constant speed in the sub-scanning direction shown by an arrow in the drawing. And then, the posterior end of the recording-paper sheet 24 passes the first position sensor 63. Thereupon, the pulse motor 55 is driven and the eccentric cam 52 is rotated from the position shown in FIG. 4 to the position shown in FIG. 5 to merely rotate the drive lever 45. Owing to this, the nip roller 34 of the upstream side commences to move to the releasing position shown in FIG. 5 in the state that the nip roller 36 of the downstream side is kept in the nip position. Before the posterior end of the recording-paper sheet 24 passes the first feeding roller pair 30, the upstream nip roller 34 is separated from the recoding-paper sheet 24. Thus, it is possible to eliminate a shock when the recording-paper sheet 24 passes through the first feeding roller pair 30.

After that, the recording-paper sheet 24 is advanced only by the second feeding roller pair 31 of the downstream side. When it is detected that the posterior end of the recording-paper sheet 24 has passed the second position sensor 64, the controller 56 supplies the drive pulse to the pulse motor 55 to rotate the eccentric cam 52 from the position shown in FIG. 5 to the position shown in FIG. 2. The nip roller 36 of the downstream side commences to move to the release position in the state that the nip roller 34 of the upstream side is kept in the release position. Consequently, the nip of the second feeding roller pair 31 is released.

As shown in FIG. 2, a ROM 70 is connected to the controller 56 via a data bus 68. The ROM 70 stores a control program for driving the nip rollers 34 and 36. The control program is read at the time of recording an image. Meanwhile, a RAM 71 connected to the controller 56 via the data bus 68 stores data concerning speeds (S1 and S2 described later) of the drive pulses to be supplied to the pulse motor 55 for moving the nip rollers 34 and 36. In addition, the RAM 71 stores the other data concerning numbers (P1 through P4 described later) of the drive pulses to be supplied to the pulse motor 55 in the respective movement stages of the nip rollers 34 and 36. The RAM 71 further stores the other data concerning time lags (T1 through T5 described later) to be taken for driving/stopping the pulse motor 55 after the position sensors 63 and 64 have detected the recording-paper sheet 24.

An operation of the feeding mechanism having the above structure is described below, referring to a timing diagram shown in FIG. 6. When the recording-paper sheet 24 is not fed or when the first position sensor 63 does not detect the anterior end of the sheet 24 notwithstanding the transport thereof, the reference-position sensor 60 makes the pulse motor 55 stop in a state that the output shaft thereof is set to an origin position. At this time, both the nip rollers 34 and 36 are kept in the release position to prevent the peripheral surface of the rollers from being deformed.

When the recording-paper sheet 24 is fed and the anterior end thereof is detected by the first position sensor 63, driving the pulse motor 55 is commenced after a time T1 to move the upstream nip roller 34 toward the nip position. The speed of the drive pulse to be supplied to the pulse motor 55 increases at a fixed rate and becomes a constant value S1. Incidentally, this drive-pulse speed corresponds to a movement speed of the nip roller 34. After that, the speed of the drive pulse decreases at a fixed rate and becomes zero when the nip roller 34 reaches the nip position. The drive pulses of a predetermined number P1 are supplied to the pulse motor 55 until the nip roller 34 reaches the nip position. It is possible to surely stop the nip roller 34 at the nip position by counting the number of the drive pulses, which are supplied to the pulse motor 55, with the counter 57.

The first feeding roller pair 30 of the nipping state feeds the recording-paper sheet 24 in the sub-scanning direction. When a leading edge of a recording area of the recording-paper sheet 24 has reached the exposure position 39, the exposure device 28 is driven to record an image on the sheet 24 one line by one line. When the second position sensor 64 detects the anterior end of the recording-paper sheet 24, the pulse motor 55 commences to rotate after a time T2 so that the downstream nip roller 36 is moved toward the nip position. The speed of the drive pulse to be supplied to the pulse motor 55 increases at a fixed rate and becomes a constant value S2. Incidentally, this drive-pulse speed corresponds to a movement speed of the nip roller 36. After that, the speed of the drive pulse decreases at a fixed rate and becomes zero when the nip roller 36 has reached the nip position (when the pulses of a number P2 have been supplied).

Figure 6:
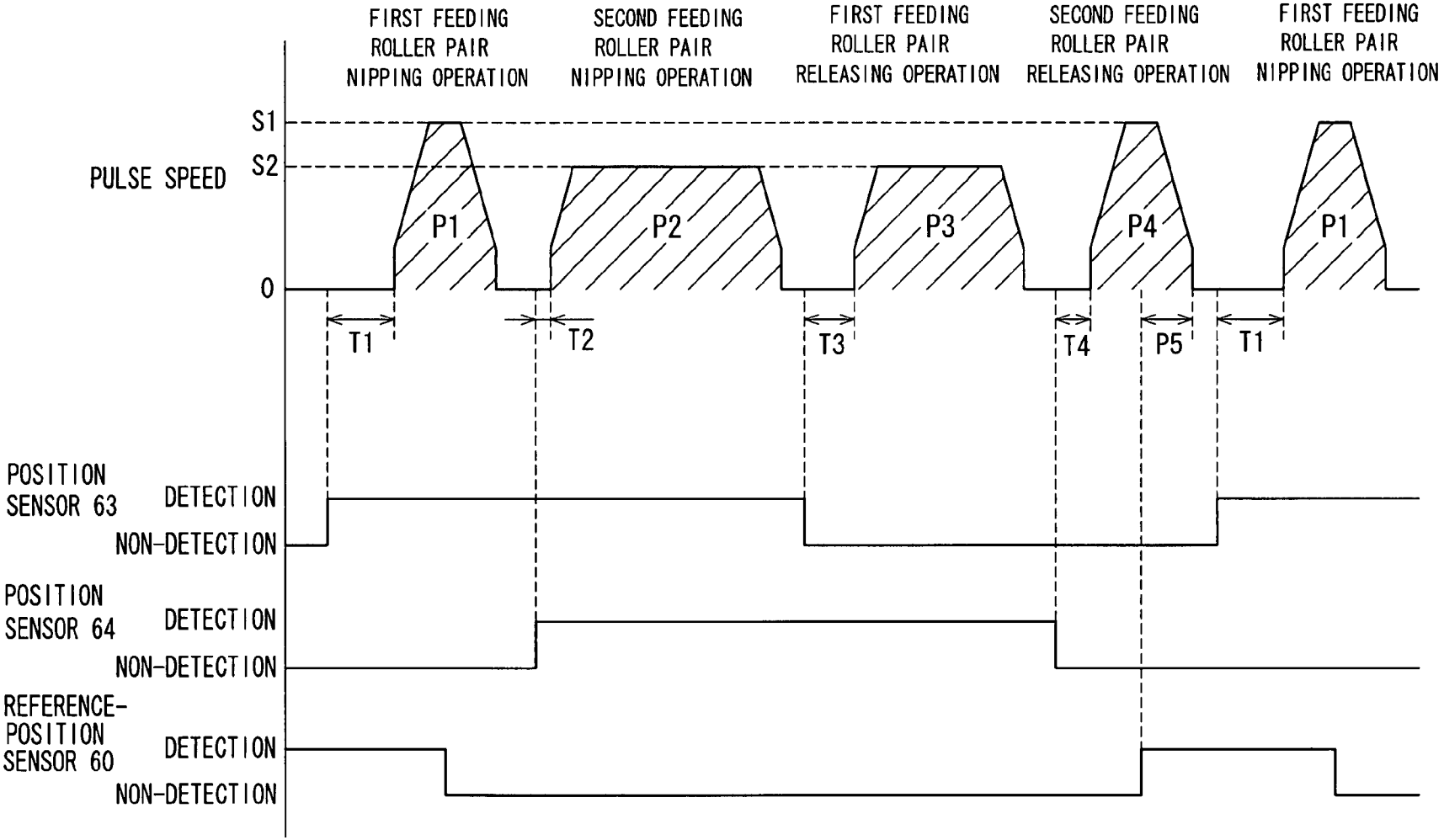
FIG. 6 is a timing diagram showing speed variation of drive pulses to be supplied to a pulse motor.

As will be apparent from FIG. 6, in the drive sequence for moving the downstream nip roller 36 to the nip position, the drive-pulse speed S2 is smaller than the drive-pulse speed S1 for moving the upstream nip roller 34 to the nip position. Thus, it is possible to hold down a shock to be caused when the downstream nip roller 36 abuts on the recording-paper sheet 24 during the image recording. Consequently, exposure unevenness may be reduced.

The image recording is performed in the state that the recoding-paper sheet 24 is nipped and fed by the first and second roller pairs 30 and 31. When the first position sensor 63 detects the posterior end of the recording-paper sheet 24, the pulse motor 55 commences to rotate after a time T3 to move the upstream nip roller 34 to the release position. The speed of the drive pulse to be supplied to the pulse motor 55 increases at a fixed rate and becomes the constant value S2. Incidentally, this drive-pulse speed corresponds to the movement speed of the nip roller 34. After that, the speed of the drive pulse decreases at a fixed rate and becomes zero when the nip roller 34 has reached the release position (namely, when the pulses of a number P3 have been supplied). Consequently, the nip roller 34 is stopped. The drive-pulse speed of this movement stage is also determined so as to be smaller, similarly to the stage for moving the downstream nip roller 36 to the nip position. Owing to this, it is possible to reduce a shock to be caused at the moment that the nip roller 34 is separated from the recording-paper sheet 24. Thus, the exposure unevenness to be caused in association with the fluctuation of the feeding speed may be effectively held down.

After that, the recording-paper sheet 24 is transported in the sub-scanning direction by the second feeding roller pair 31 kept in the nip state. When the second position sensor 64 detects the posterior end of the recording-paper sheet 24, the pulse motor 55 commences to rotate after a time T4 to move the downstream nip roller 36 to the release position. The speed of the drive pulse to be supplied to the pulse motor 55 increases at a fixed rate and becomes the constant value S1. Incidentally, this drive-pulse speed corresponds to the movement speed of the nip roller 36. And then, the speed of the drive pulse decreases at a fixed rate and becomes zero when the nip roller 36 has reached the release position (namely, when the pulses of a number P4 have been supplied). Consequently, the nip roller 36 is stopped. In the stage for moving the downstream nip roller 36 to the release position, the pulse motor 55 is controlled so as to be stopped when the drive pulses of a number P5 has been counted after detecting the projection 55*a* with the reference-position sensor 60.

By the above-described operation, one sheet 24 passes the exposure device 28. Successively, the similar operation is performed when the next sheet 24 reaches the exposure device 28. In doing so, the recording-paper sheets 24 are fed in the condition that the shock to be caused by the nipping/releasing operation of the nip rollers 34 and 36 is held down.

When the length and the feeding speed of the recording-paper sheet 24 are within the limits of design, driving the pulse motor 55 pauses in accordance with a timing diagram shown in FIG. 6 whenever the drive pulses of the predetermined numbers (P1 to P4) are supplied in the respective movement sequences. However, in case the length and the feeding speed of the recording-paper sheet 24 are out of the limits of design, movement timing of the nip rollers 34 and 36 sometimes overlap. In such a case, the nipping/releasing operations of the nip rollers 34 and 36 lag, so that it is judged that movement errors occur. Due to this, it has been necessary to temporarily stop feeding the recording-paper sheet 24 and to stop the whole operation of the photo printer.

In view of this, the printing process is adapted to be performed by continuously driving the pulse motor 55 without stopping the movement of the recording-paper sheet 24 when the movement timing of the nip rollers 34 and 36 overlap. For example, the system controller 56 detects the speed of the drive pulses supplied to the pulse motor 55 at the moment that the downstream nip roller 36 is moved to the nip position (at the moment that the time T2 has passed after detecting the recording-paper sheet 24 with the second position sensor 64). And then, the system controller 56 changes the drive-pulse speed in accordance with the detected drive-pulse speed to drive the pulse motor at the speed S2.

Figure 7A:
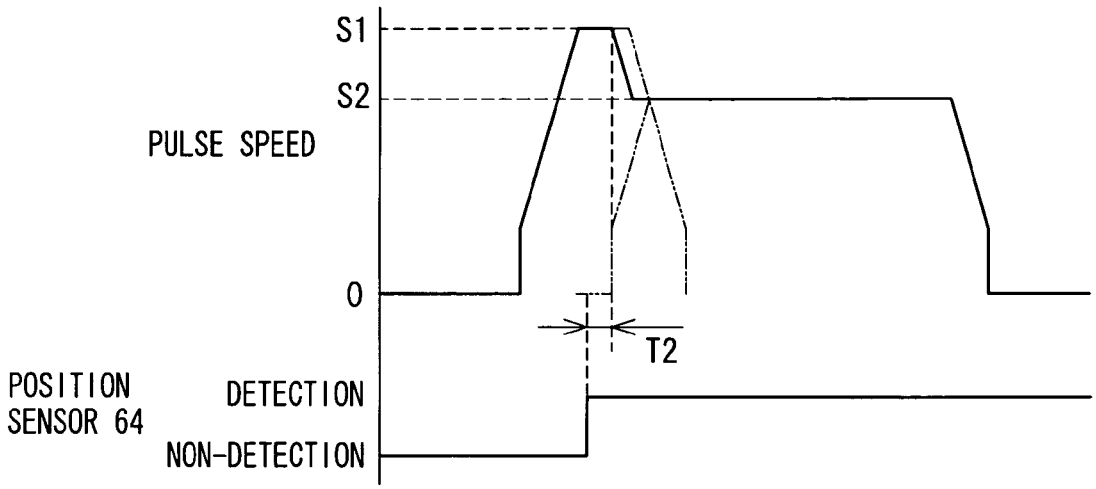
FIGS. 7A, 7B and 7C are timing diagrams showing speed variation of the drive pulses in a condition that movement timing of the downstream nip roller occurs while the upstream nip roller is moved.

Such as shown in FIG. 7A, when the drive-pulse speed is S1 at the moment that the downstream nip roller 36 is moved, the controller 56 decreases the drive-pulse speed to drive the pulse motor 55 at the pulse speed S2. And then, driving the pulse motor 55 is stopped when the number of the successively-supplied drive pulses becomes (P1+P2). At this time, the downstream nip roller 36 reaches the nip position and stops in this state.

Figure 7B:
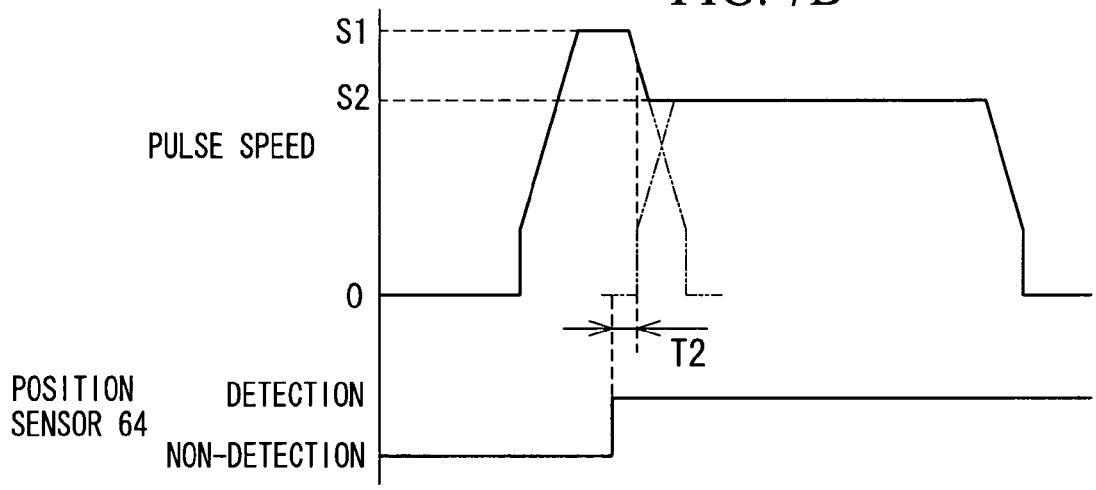
Figure 7C:
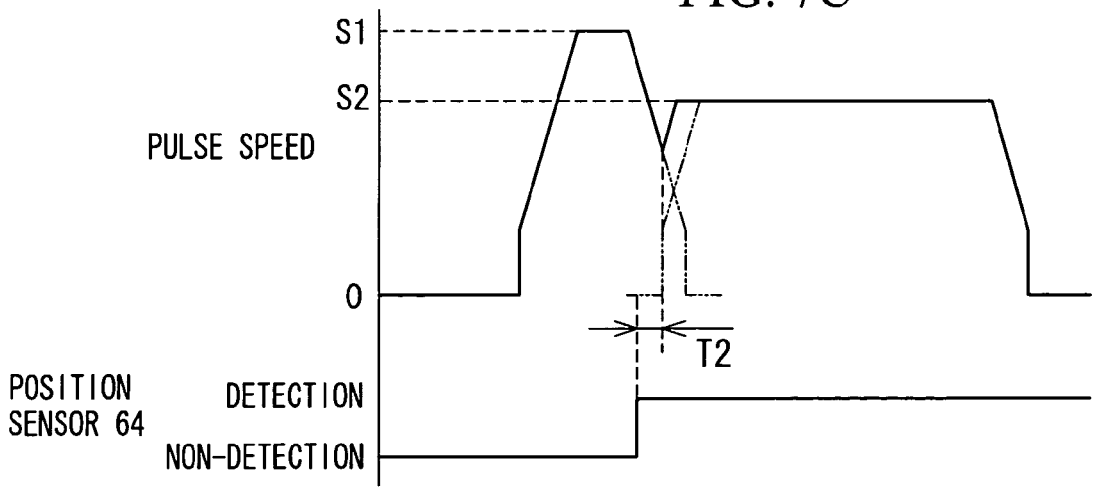

In the meantime, such as shown in FIG. 7B, when the drive-pulse speed is between S1 and S2 at the moment that the downstream nip roller 36 is moved, the pulse speed is decreased at a fixed rate until the drive-pulse speed becomes S2. After that, the pulse motor 55 is driven at the speed S2. Meanwhile, when the drive-pulse speed is smaller than S2 at the moment that the downstream nip roller 36 is moved (see FIG. 7C), the pulse speed is increased at a fixed rate until the drive-pulse speed becomes S2. After that, the pulse motor 55 is driven at the speed S2. In both of these cases, driving the pulse motor 55 is stopped when the number of the successively-supplied drive pulses becomes (P1+P2).

When the timing for driving the downstream nip roller 36 occurs during the drive of the pulse motor 55, a delay of timing for nipping the recording-paper sheet 24 with the nip roller 36 may be reduced by successively driving the pulse motor 55 at the speed S2 in a prompt manner. In virtue of this, it is unnecessary to stop the movement of the recording-paper sheet 24 so that processing ability of the photo printer may be constantly maintained. Since the drive speed of the pulse motor 55 is adapted to be S2, a shock may be held down when the nip roller 36 abuts on the recording-paper sheet 24.

Figure 8A:
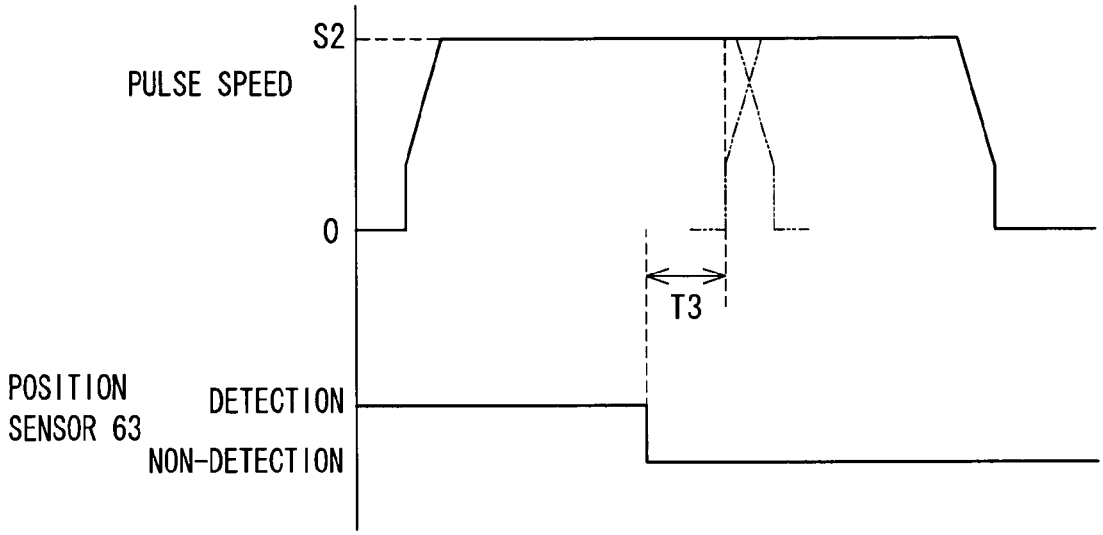
FIGS. 8A and 8B are timing diagrams showing speed variation of the drive pulses in a condition that movement timing of the upstream nip roller occurs while the downstream nip roller is moved.
Figure 8B:
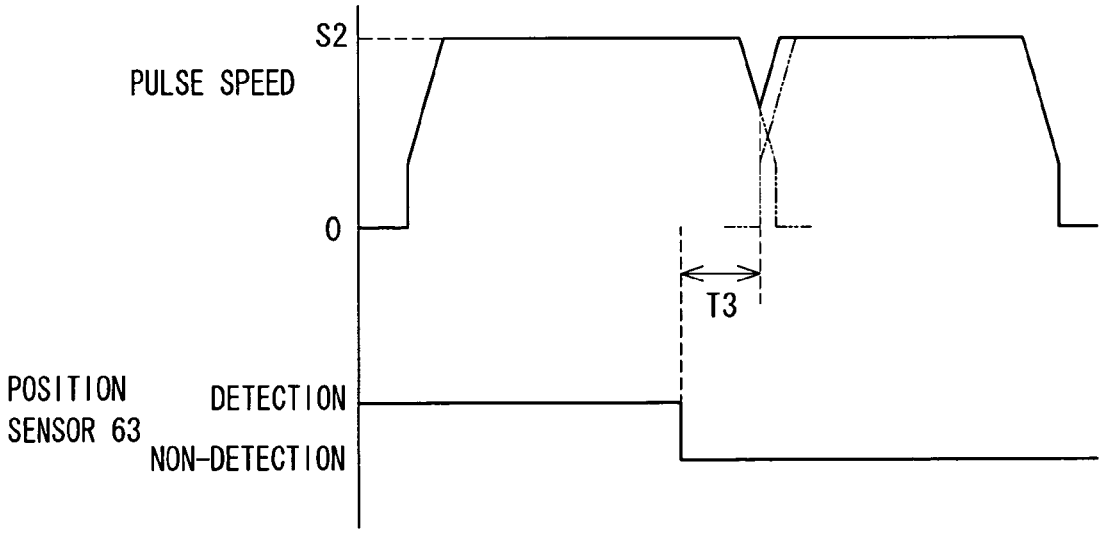

When the timing for moving the upstream nip roller 34 to the release position occurs during the drive of the pulse motor 55, the pulse motor 55 is successively driven in the similar manner. In other words, such as shown in FIG. 8A, when the drive-pulse speed is S2 at the moment that the upstream nip roller 34 is moved (at the moment that the time T3 has passed after detecting the posterior end of the recording-paper sheet 24 with the first position sensor 63), the controller 56 keeps the drive-pulse speed at S2. When the number of the supplied pulses becomes (P2+P3), the controller 56 stops driving the pulse motor 55. At this time, the upstream nip roller 34 is stopped at the release position. Meanwhile, such as shown in FIG. 8B, when the drive-pulse speed is smaller than S2 at the moment that the upstream nip roller 34 is moved, the pulse speed is increased at a fixed rate until the drive-pulse speed becomes S2. After that, the pulse motor 55 is driven at the speed S2. When the number of the supplied pulses becomes (P2+P3), driving the pulse motor 55 is stopped. Owing to this, a delay of timing for moving the nip roller 34 to the release position may be reduced.

Figure 9A:
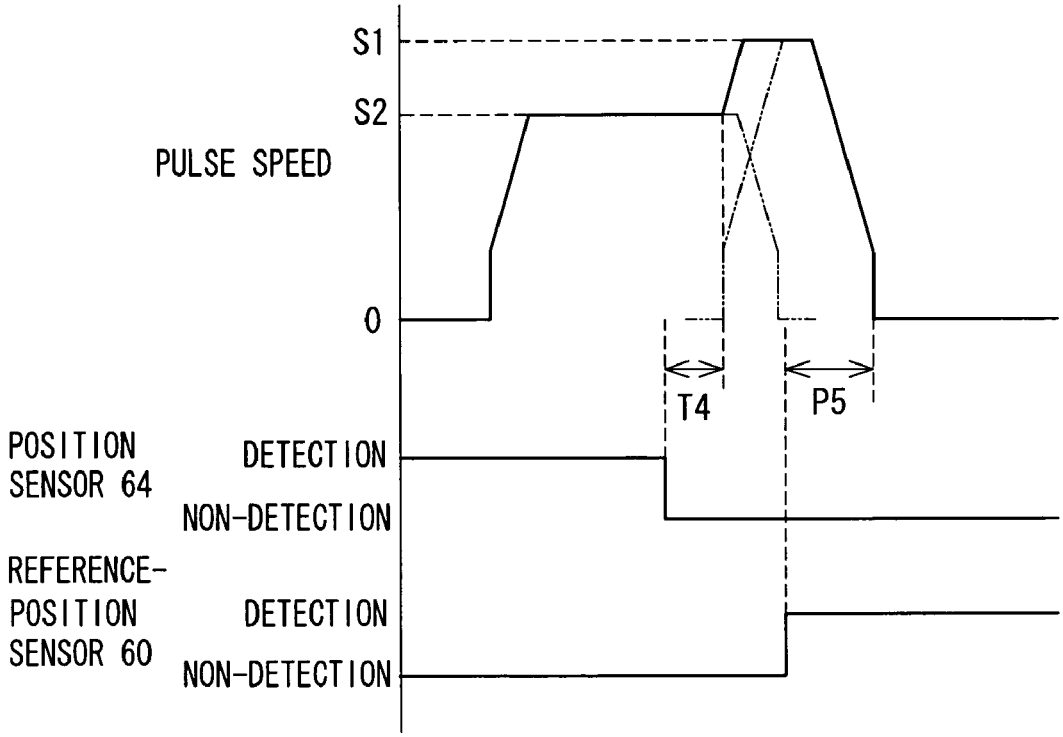
FIGS. 9A and 9B are timing diagrams showing speed variation of the drive pulses in a condition that movement timing of the downstream nip roller occurs while the upstream nip roller is moved.
Figure 9B:
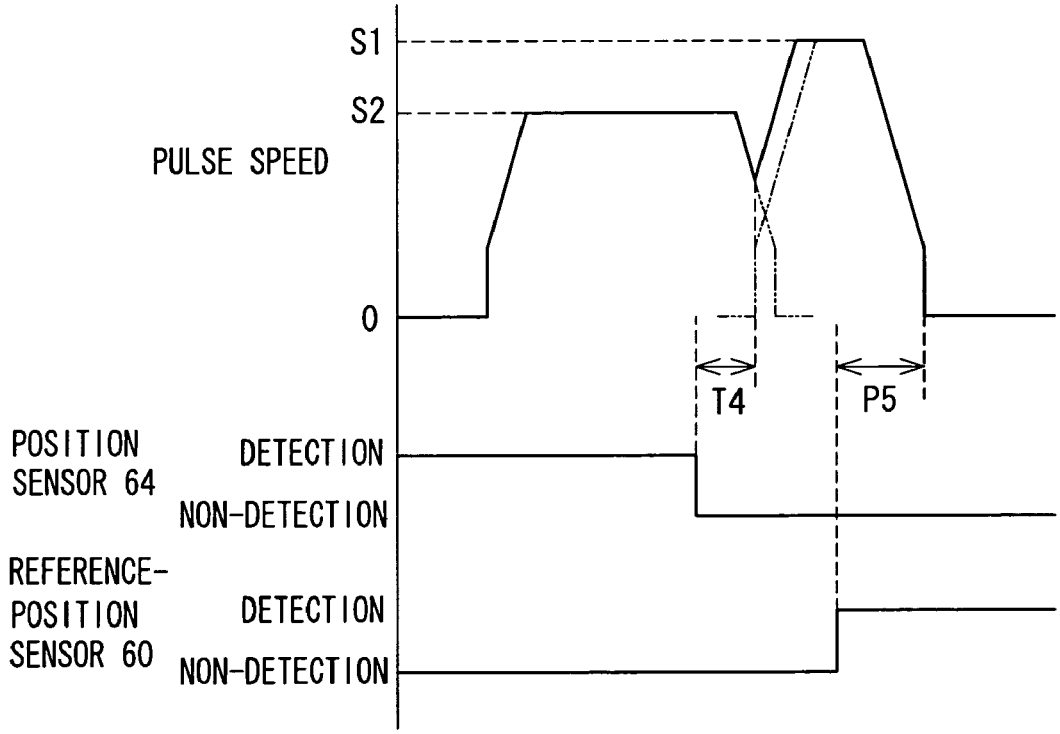

When the timing for moving the downstream nip roller 36 to the release position occurs during the drive of the pulse motor 55, the pulse motor 55 is successively driven without making the pulse speed zero. Such as shown in FIG. 9A, when the drive-pulse speed is S2 at the moment that the downstream nip roller 36 is moved (at the moment that the time T4 has passed after detecting the posterior end of the recording-paper sheet 24 with the second position sensor 64), the controller 56 increases the drive-pulse speed up to S1 to move the nip roller 36. When the pulses of the number P5 are supplied after detecting the projection 55*a* with the reference-position sensor 60, driving the pulse motor 55 is stopped. At this time, both of the nip rollers 34 and 36 are stopped at the release position. Meanwhile, when the drive-pulse speed is smaller than S2 at the moment that the downstream nip roller 36 is moved, the pulse speed is increased at a fixed rate until the drive-pulse speed becomes S1, such as shown in FIG. 9B. After that, the pulse motor 55 is driven at the speed S1. And then, when the pulses of the number P5 are supplied after detecting the projection 55*a* with the reference-position sensor 60, driving the pulse motor 55 is stopped.

Figure 10A:
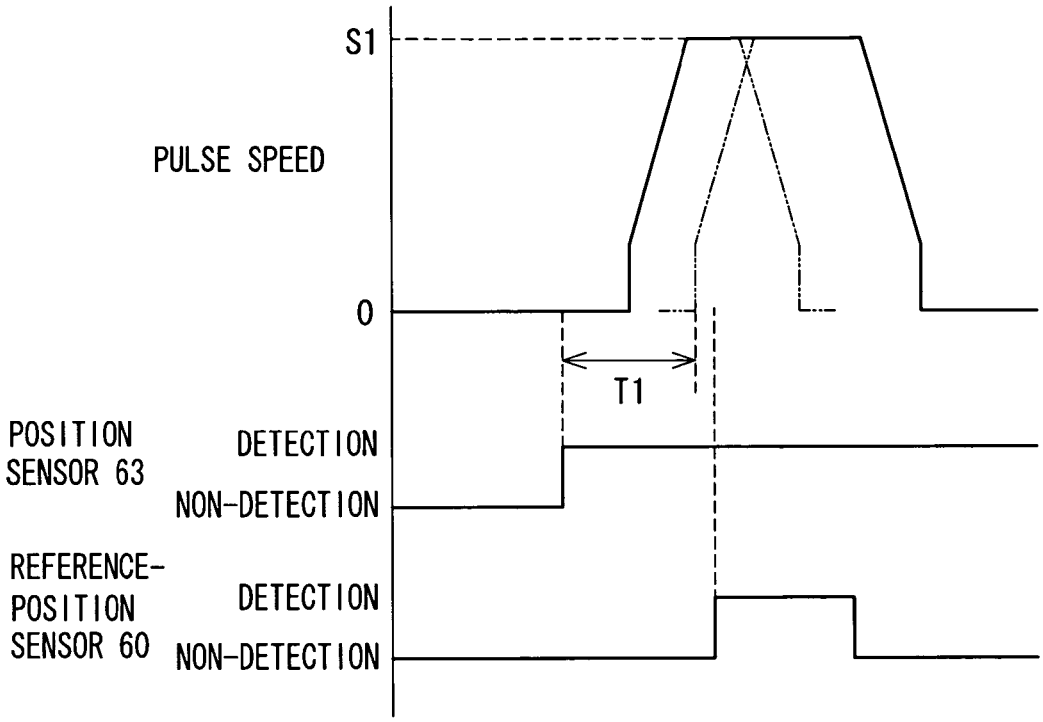
FIGS. 10A and 10B are timing diagrams showing speed variation of the drive pulses in a condition that movement timing of the upstream nip roller occurs while the downstream nip roller is moved.
Figure 10B:
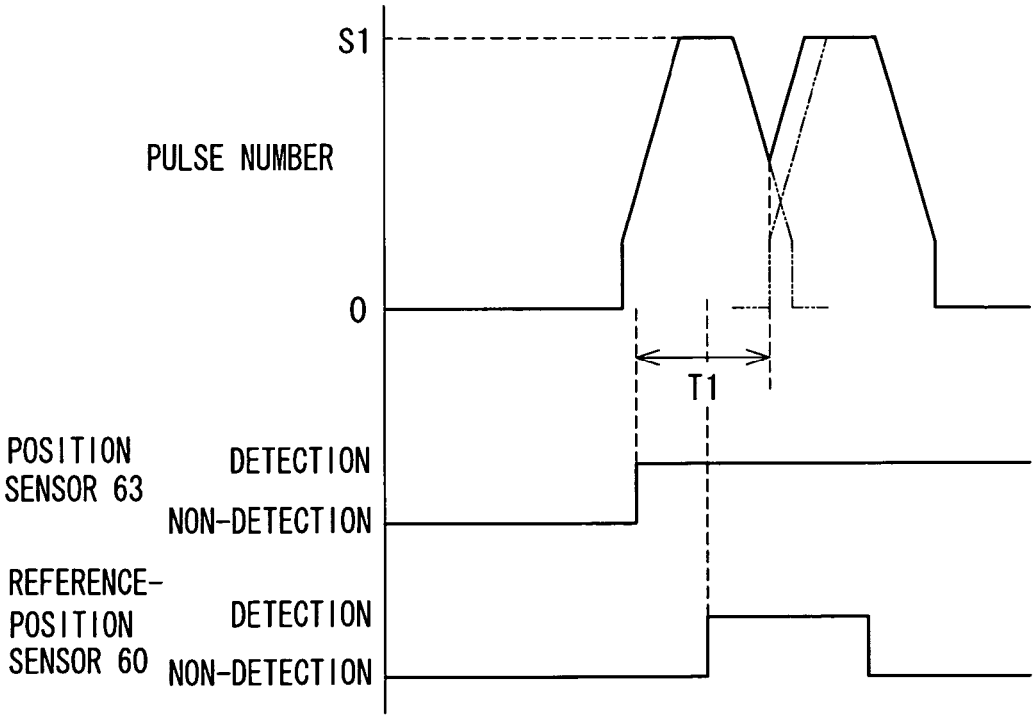

When the timing for moving the upstream nip roller 34 to the nip position occurs during the drive of the pulse motor 55, the pulse motor 55 is successively driven without making the pulse speed zero. Such as shown in FIG. 10A, when the drive-pulse speed is S1 at the moment that the upstream nip roller 34 is moved (at the moment that the time T1 has passed after detecting the recoding-paper sheet 24 with the first position sensor 63), the controller 56 keeps the drive-pulse speed at S1 to move the nip roller 34. And then, when the pulses of the number (P5+P1) are supplied after detecting the projection 55*a* with the reference-position sensor 60, namely when the number of the successively-supplied pulses becomes (P4+P1), driving the pulse motor 55 is stopped. At this time, the upstream nip roller 34 is stopped at the nip position. Meanwhile, such as shown in FIG. 10B, when the drive-pulse speed is smaller than S1 at the moment that the upstream nip roller 34 is moved, the pulse speed is increased at a fixed rate until the drive-pulse speed becomes S1. After that, the pulse motor 55 is driven at the speed S1. And then, when the pulses of the number (P5+P1) are supplied after detecting the projection 55*a* with the reference-position sensor 60, driving the pulse motor 55 is stopped.

In the above embodiment, the pulse speed is increased and decreased on the basis of the dive-pulse speed detected at the moment that the nip rollers 34 and 36 are moved. However, the drive-pulse speed at the moment of moving the nip rollers 34 and 36 may be calculated by reading information, which concerns the supplied-pulse number, from the counter 57 when the position sensors 63 and 64 have detected the recording-paper sheet 24. Since a maximum value and acceleration of the drive-pulse speed are predetermined in the respective movement stages, the drive-pulse speed to be set after the times T1 to T4 can be calculated by easy operation.

Incidentally, in the case the timing for moving the nip rollers have overlapped, it is preferable to record information concerning the overlap. Concretely, in the case of the movement timing shown in FIGS. 7 through 10, an occurrence number thereof is recorded in the RAM 71. The information concerning the occurrence number is read from the RAM 71 at the time of checking the photo printer to detect the stage during which the movement timing of the nip rollers are likely to overlap. It is possible to prevent the movement timing from overlapping by changing the times T1 to T4 and the pulse speeds S1 and S2.

The above embodiment relates to only the case in that two kinds of the movement timing overlap. The present invention, however, may be adopted to another case in that three or more kinds of the movement timing overlap.

Figure 11:
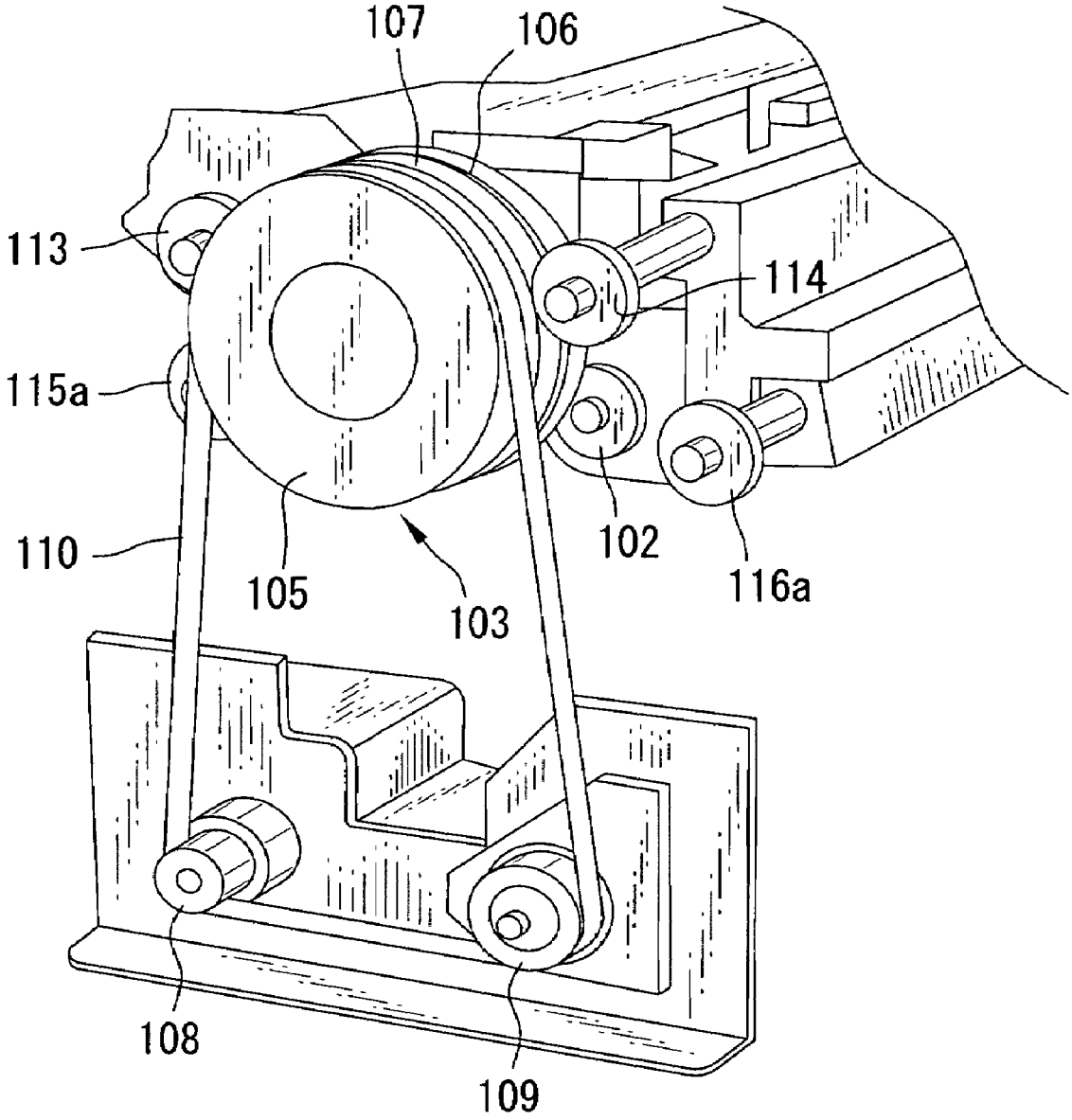
FIG. 11 is a perspective view schematically showing another embodiment of the feeding mechanism.
Figure 12:
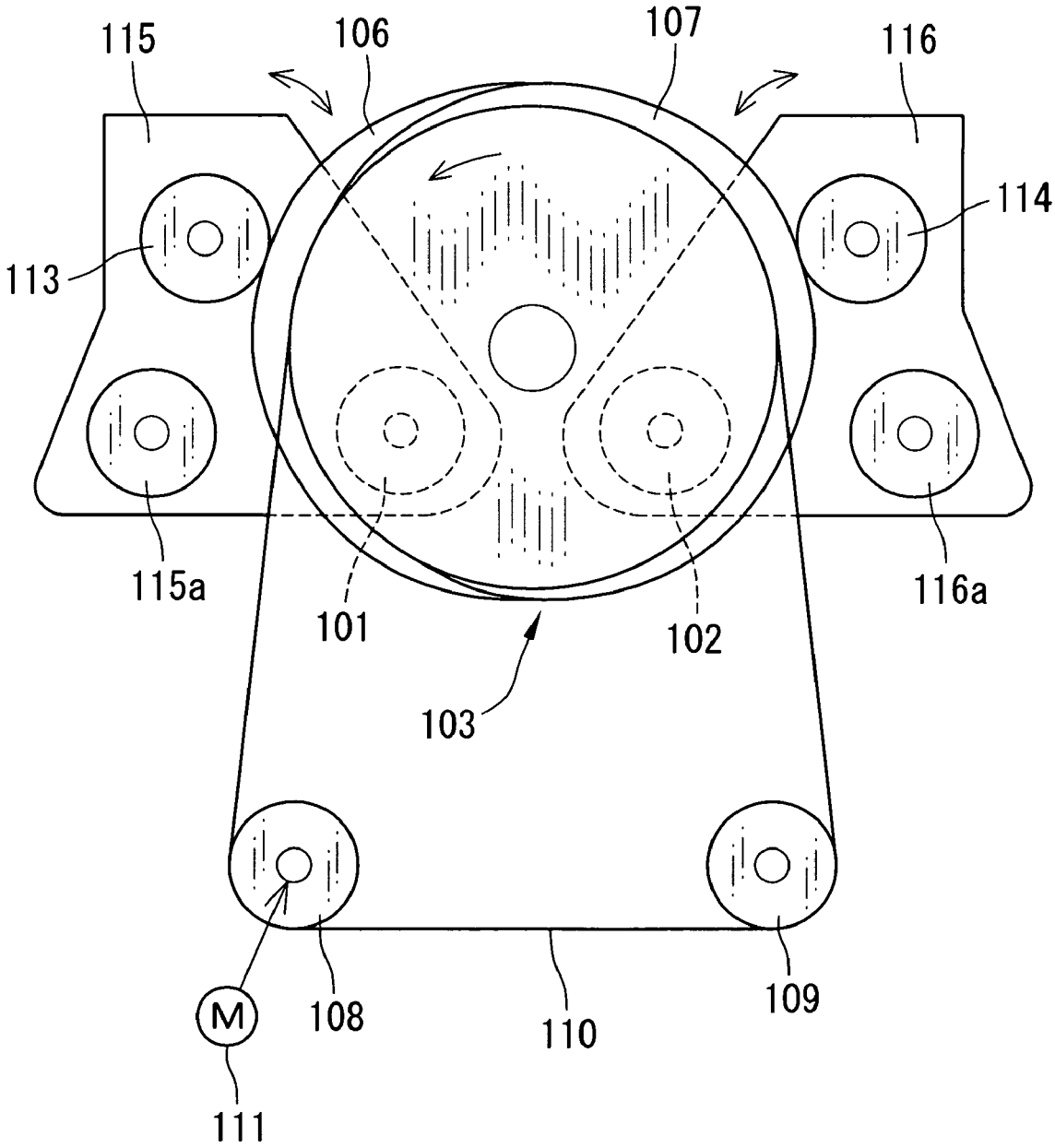
FIG. 12 is a plan view schematically showing a structure of the feeding mechanism shown in FIG. 11.

The mechanism for moving the nip roller is not limited to the above embodiment. For example, it is possible to employ the mechanism shown in FIGS. 11 and 12. In this embodiment, an upstream nip roller 101 and a downstream nip roller 102 are vertically moved by rotating a cam unit 103 to nip the recording-paper sheet with a capstan roller, which is not shown, and to release the nip of the recording-paper sheet.

The cam unit 103 comprises a drive cam 105, a first cam 106 and a second cam 107, which are disposed in an axial direction of the nip rollers 101 and 102. A timing belt 110 is laid between the drive cam 105 and two pulleys 108 and 109. Upon driving a pulse motor 111 connected to the pulley 108, the timing belt 110 is moved to rotate the drive cam 105 around a rotary shaft in a counterclockwise direction. At this time, the first cam 106 and the second cam 107 fixed to the drive cam 105 are rotated in the counterclockwise direction.

Peripheral surfaces of the first cam 106 and the second cam 107 respectively abut on first and second cam followers 113 and 114 urged toward the cam unit 103. The first cam follower 113 and the upstream nip roller 101 are supported by a base member 115 and are capable of revolving around a rotary shaft 115*a*. Similarly, the second cam follower 114 and the downstream nip roller 102 supported by a base member 116 are capable of revolving around a rotary shaft 116*a*.

When the pulse motor 111 is driven to rotate the cam unit 103 in the counterclockwise direction, the first cam follower 113 moves in a radial direction of the cam unit 103, abutting on the first cam 106. In association with this movement, the upstream nip roller 101 moves between a nip position for nipping the recording-paper sheet with the capstan roller, which is not shown, and a release position for separating from the capstan roller. Similarly, the second cam follower 114 moves, abutting on the second cam 107, so that the downstream nip roller 102 moves between the nip position and the release position.

In the moving mechanism having the above structure, when the timing for moving the nip roller occurs during the drive of the pulse motor 111, it is possible to reduce a delay of timing for nipping the recording-paper sheet with the nip roller by successively driving the pulse motor 111 along the sequences shown in FIGS. 7 to 10.

The above embodiments are described with the feeding mechanism in which two nip rollers are moved by using the sole pulse motor. The present invention, however, may be applied to another feeding mechanism in which pulse motors for driving the respective nip rollers are provided. In this case, when the timing for driving one nip roller occurs during the movement of the other nip roller, the pulse motors are simultaneously driven to simultaneously move the nip rollers without stopping the recording-paper sheet as a result of judging an abnormal condition.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A feeding method for a sheet-shaped recording material, wherein an upstream roller pair and a downstream roller pair are respectively disposed at an upstream side and a downstream side of a recording position in a feeding direction of said recording material, and said upstream roller pair including an upstream movable roller and said downstream roller pair including a downstream movable roller, said upstream movable roller and said downstream movable roller are respectively movable between a nip position for nipping and feeding said recording material, and a release position for releasing the nip of said recording material, said feeding method comprising the steps of:

(a) performing a movement operation of one of the movable rollers;

(b) judging whether or not timing for moving the other movable roller occurs during the movement operation of said one of the movable rollers; and (c) prioritizing a movement operation of the other movable roller when the timing has occurred.

2. A feeding method according to claim 1, wherein said upstream movable roller and said downstream movable roller are moved by a single pulse motor, and drive pulses having speeds of S1 and S2 are respectively supplied to said pulse motor at the time of the movement operations of said upstream movable roller and said downstream movable roller, said step (c) further including the step of:

(c1) controlling said pulse motor such that the speed of the drive pulse to be supplied to said pulse motor becomes S2 when the speed of the drive pulses supplied to said pulse motor is different from S2 at the time of occurrence of said timing.

3. A feeding method according to claim 2, wherein a number of the drive pulses necessary for the movement operation of only said one of the movable rollers is P1, and a number of the drive pulses necessary for the movement operation of only the other movable roller is P2, said step (c) further including the step of:

(c2) successively supplying (P1+P2) drive pulses to said pulse motor from commencement of the movement operation of said one of the movable rollers.

4. A feeding method according to claim 2, wherein said pulse motor is controlled such that the speed of the drive pulses to be supplied to said pulse motor becomes S2 when the speeds S1 and S2 are same and the timing has occurred during a stop control of said one of the movable rollers.

5. A feeding method according to claim 2, wherein said downstream movable roller reaches said nip position after an anterior end of said recording material has passed through said downstream roller pair, and a movement speed to the nip position is slower than a movement speed to the release position.

6. A feeding method according to claim 2, wherein said upstream movable roller moves toward said release position before an posterior end of said recording material passes through said upstream roller pair, and a movement speed to the release position is slower than a movement speed to the nip position.

7. A feeding method according to claim 2, further comprising the step of:

counting an occurrence number of said timing.

8. A feeding apparatus for a sheet-shaped recording material, wherein an upstream roller pair and a downstream roller pair are respectively disposed at an upstream side and a downstream side of a recording position in a feeding direction of said recording material, and said upstream roller pair including an upstream movable roller and said downstream roller pair including a downstream movable roller, said up stream movable roller and said downstream movable roller are respectively movable between a nip position for nipping and feeding said recording material, and a release position for releasing the nip of said recording material, said feeding apparatus comprising:

a first moving mechanism for performing a movement operation of one of the movable rollers;

a second moving mechanism for performing a movement operation of the other movable roller; and a controller for judging whether or not timing for moving the other movable roller occurs during the movement operation of said one of the movable rollers, said controller prioritizing the movement operation of the other movable rollers when the timing has occurred.

9. A feeding apparatus according to claim 8, wherein said upstream movable roller and said downstream movable roller are moved by a single pulse motor, and drive pulses having speeds of S1 and S2 are respectively supplied to said pulse motor at the time of the movement operations of said upstream movable roller and said downstream movable roller, said controller controlling said pulse motor such that the speed of the drive pulse to be supplied to said pulse motor becomes S2 when the speed of the drive pulses supplied to said pulse motor is different from S2 at the time of occurrence of said timing.

10. A feeding apparatus according to claim 9, wherein a number of the drive pulses necessary for the movement operation of only said one of the movable rollers is P1, and a number of the drive pulses necessary for the movement operation of only the other movable roller is P2, said controller successively supplying (P1+P2) drive pulses to said pulse motor from commencement of the movement operation of said one of the movable rollers.

11. A feeding apparatus according to claim 9, wherein said pulse motor is controlled such that the speed of the drive pulses to be supplied to said pulse motor becomes S2 when the speeds S1 and S2 are same and the timing has occurred during a stop control of said one of the movable rollers.

12. A feeding apparatus according to claim 9, further comprising:

a first position sensor disposed at an upstream side of said upstream roller pair in the feeding direction of said recording material, said first position sensor actuating said upstream movable roller after detecting a passage of said recording material; and a second position sensor disposed at an upstream side of said downstream roller pair in the feeding direction of said recording material, said second position sensor actuating said downstream movable roller after detecting a passage of said recording material.

13. A feeding apparatus according to claim 9, further comprising:

a memory for storing an occurrence number of said timing.

14. A feeding apparatus according to claim 9, wherein said first moving mechanism includes:

an eccentric cam rotated by said pulse motor; and a first drive lever, one end of which abuts on said eccentric cam and the other end of which is connected to said upstream movable roller, said first drive lever rotating in association with a rotation of said eccentric cam to move said upstream movable roller between said nip position and said release position.

15. A feeding apparatus according to claim 14, wherein said second moving mechanism includes:

a second drive lever, one end of which abuts on said eccentric cam and the other end of which is connected to said downstream movable roller, said second drive lever rotating in association with the rotation of said eccentric cam to move said downstream movable roller between said nip position and said release position.

16. A feeding apparatus according to claim 9, wherein said first mechanism comprises:

a drive cam rotated by said pulse motor;

a first eccentric cam fixed to said drive cam and integrally rotating therewith;

a first cam follower abutting on said first eccentric cam, said first cam follower moving in association with a rotation of said first eccentric cam in a radius direction of said drive cam; and a first base member for supporting said first cam follower and said upstream movable roller, said first base member rotating in association with a movement of said first cam follower to move said upstream movable roller between said nip position and said release position.

17. A feeding apparatus according to claim 16, wherein said second moving mechanism includes:

a second eccentric cam fixed to said drive cam and integrally rotating therewith;

a second cam follower abutting on said second eccentric cam, said second cam follower moving in association with a rotation of said second eccentric cam in the radius direction of said drive cam; and a second base member for supporting said second cam follower and said downstream movable roller, said second base member rotating in association with a movement of said second cam follower to move said downstream movable roller between said nip position and said release position.

* * * * *